US006990959B1

(12) United States Patent
Zdroik et al.

(10) Patent No.: US 6,990,959 B1
(45) Date of Patent: Jan. 31, 2006

(54) FUEL RAIL DELIVERY SYSTEM ARRANGEMENT

(75) Inventors: Michael J. Zdroik, Metamora, MI (US); Robert Doherty, Syracuse, IN (US); Jackson Zel Roe, Goshen, IN (US)

(73) Assignee: Millennium Industries Corp., Auburn Hills, MI (US)

( * ) Notice: Subject to any disclaimer, the term of this patent is extended or adjusted under 35 U.S.C. 154(b) by 0 days.

(21) Appl. No.: 11/003,065

(22) Filed: Dec. 3, 2004

(51) Int. Cl.
*F02M 37/04* (2006.01)

(52) U.S. Cl. ..... 123/456; 123/468; 123/184.31; 123/184.61

(58) Field of Classification Search ..... 123/456, 123/468, 469, 184.31, 184.61
See application file for complete search history.

(56) References Cited

U.S. PATENT DOCUMENTS 6,019,089 A * 2/2000 Taylor et al. ..... 123/470
6,341,595 B1 * 1/2002 Scollard et al. ..... 123/456
6,619,264 B2 * 9/2003 Bolsover et al. ..... 123/456
2005/0115544 A1 * 6/2005 Kim ..... 123/456
2005/0139196 A1 * 6/2005 Seymour ..... 123/456

* cited by examiner

*Primary Examiner*—Thomas Moulis
(74) *Attorney, Agent, or Firm*—Dykema Gossett PLLC

(57) ABSTRACT

An air fuel delivery system arrangement for an engine is provided, including an air manifold body, having a first set of runners for a first cylinder bank with inlets on a first side and outlets on a second side of the manifold body and a second set of runners for a second cylinder bank with inlets on a second side and outlets on a first side. And a first fuel rail is included, having outlets for connection with fuel injectors for delivering fuel to the first cylinder bank being positioned generally between the inlets of the manifold body. A second fuel rail is also included, having outlets for connection with fuel injectors for delivering fuel to the second cylinder bank being positioned generally between the inlets of the manifold body being generally vertically aligned with the first fuel rail.

27 Claims, 4 Drawing Sheets

FUEL RAIL DELIVERY SYSTEM ARRANGEMENT

FIELD OF THE INVENTION

The field of the present invention is air and fuel delivery system arrangements for reciprocating piston, internal combustion engines. The present invention relates particularly to V-type internal combustion engines having spark-ignited, multiple injector fuel systems.

BACKGROUND OF THE INVENTION

In order to increase fuel economy, there has been a constant quest to reduce the physical envelope of the vehicle engine so that the engine compartment may be made smaller to accomplish aerodynamic improvements in the overall vehicle. Additionally, another trend to improve vehicle fuel economy is to go to fuel injection systems wherein each engine cylinder receives fuel from an individualized fuel injector.

Most V-type automotive engines utilize two separate fuel manifolds (more commonly referred to as fuel rails), which deliver fuel pressurized by a fuel pump to a group or bank of fuel injectors. In most applications, the fuel rails are connected to brackets. The brackets typically are spaced apart and an air manifold is placed between the two separate fuel rails. It is well known to those skilled in the art that many automotive vehicles which utilize fuel injectors, require some method of dampening pressure pulsations (caused by the rapid opening and closing of the fuel injectors) within the fuel rail so that there may be an accurate delivery of fuel by the fuel injectors.

Initially, fuel pressure pulsations were mainly dampened by the addition of a pressure dampener connected directly to the fuel rail or via a line leading to the fuel rail. Increasingly, it has been desirable to eliminate using a separate component damper and to utilize the fuel rail itself for dampening pulsations. This tendency of utilizing the fuel rail itself to dampen pulsations has caused the overall size of fuel rails to generally increase.

It is desirable that the space envelope taken up by the fuel delivery system of the vehicle be minimized due to overall engine compartment space considerations. It is desirable to provide an air fuel delivery system wherein for a V-type engine, both fuel rails may be placed in a more central location.

SUMMARY OF THE INVENTION

To make manifest the above-noted and other desires, a revelation of the present invention is brought forth. In a preferred embodiment, the present invention provides an air fuel delivery system arrangement for a V-type reciprocating piston internal combustion engine. The arrangement includes a portion of the air manifold body having a first set of runners for a first engine cylinder bank having air inlets on a first side and air outlets on a second side. A second set of runners is provided, having air inlets on the second side and air outlets on the first side for delivering air to a second bank of cylinders of the engine. A first fuel rail is provided which has cupped injector outlets which are generally aligned with fuel injector inlets for the first engine bank. The first fuel rail is positioned between the inlets of the first and second sets of runners of the air manifold.

A second fuel rail is also provided. The second fuel rail has a series of cupped outlets also. The second fuel rail delivers fuel via fuel injectors which are connected between the second fuel rail and fuel injector inlets for the second bank of engine cylinders. The second fuel rail is positioned generally vertically adjacent with the first fuel rail.

The present invention is advantageous in that it allows the fuel rails to be placed generally vertically aligned with each other and also allows their placement at a central point of the engine when utilizing V-type engines. Additionally, the inventive fuel air delivery system arrangement allows for easier installation of the fuel injectors between the fuel rails and the fuel injector inlets and also allows for placement of the fuel injectors in such a manner that minimizes opportunities for damaging the fuel injector due to misalignment during assembly.

Further features and advantages of the present invention will become more apparent to those skilled in the art after a review of the invention as it is shown in the accompanying drawings and detailed description.

DETAILED DESCRIPTION OF THE INVENTION

Referring to FIGS. 1–4, an air fuel delivery system arrangement 7 is provided. This air fuel delivery system arrangement is preferably used in a V-type reciprocating piston, spark-ignited, internal combustion engine. The air fuel delivery system arrangement 7 is particularly useful in V-type engines wherein the combustion cylinders are inclined from one another 60 degrees or less, which typically has most applications in automotive engines that are transverse mounted in front wheel drive vehicles.

Figure 4:
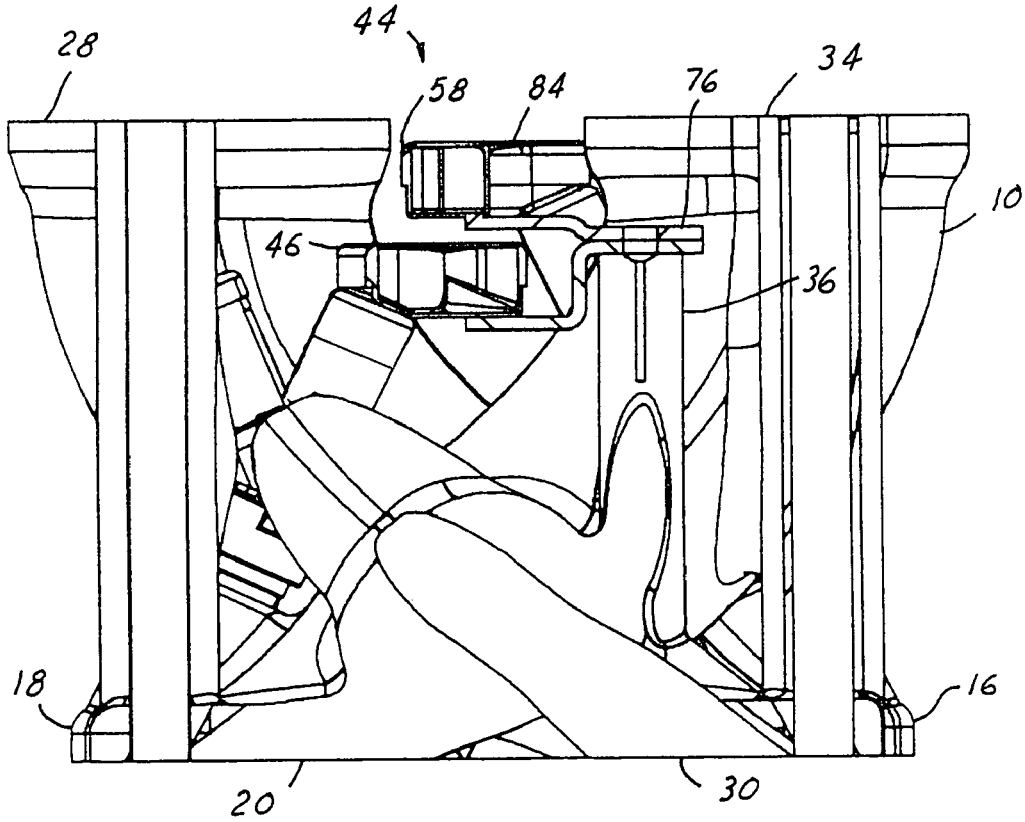
FIG. 4 is a sectional view of the air fuel delivery system arrangement shown in FIGS. 1 and 2.
Figure 5:
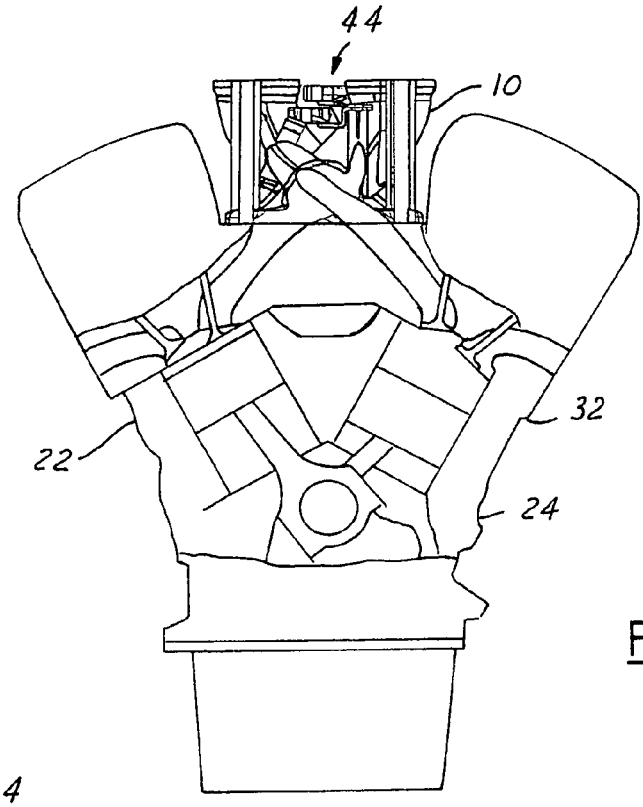
FIG. 5 is a schematic view of a V-type engine utilizing an air fuel delivery system arrangement according to the present invention.

The arrangement 7 includes an air manifold body 10. The air manifold body 10 is typically a molded thermoplastic polymeric material such as Nylon®, plastic or can be aluminum or other suitable material. Often, the material will be fiberglass reinforced. The manifold body has a first set of runners 12. The runners 12 have air inlets 14 on a first side 16 of the air manifold body. The air manifold body 10, on its second side 18, has a series of air outlets 20 for the runners 12. The air outlets 20 deliver air to a first cylinder bank 22 of a spark-ignited, internal combustion engine 24 (FIG. 4).

In a similar manner, the air manifold body 10 has a second set of runners 26, with air inlets 28 on side 18 of the air manifold body and air outlets 30 on side 16 of the air manifold body. The second set of runners 26 deliver air to the cylinders of the engine 24 on a second bank 32.

The air manifold body 10 has a series of outer fastener towers 34 to allow the air manifold body to be connected to an upper portion of the air manifold (not shown). A set of fastener apertures 25 allow the air manifold body 10 to be connected with a head of the engine 24. The air manifold body 10 also has two (only one shown in FIG. 3) fuel rail connection towers 36.

The air manifold body 10, for each runner, has a fuel injector inlet 38. The fuel injector inlet 38 allows for insertion of a fuel injector to allow the fuel injector outlet (not shown) to disperse fuel into a passage which is in close proximity with the runner.

Figure 1:
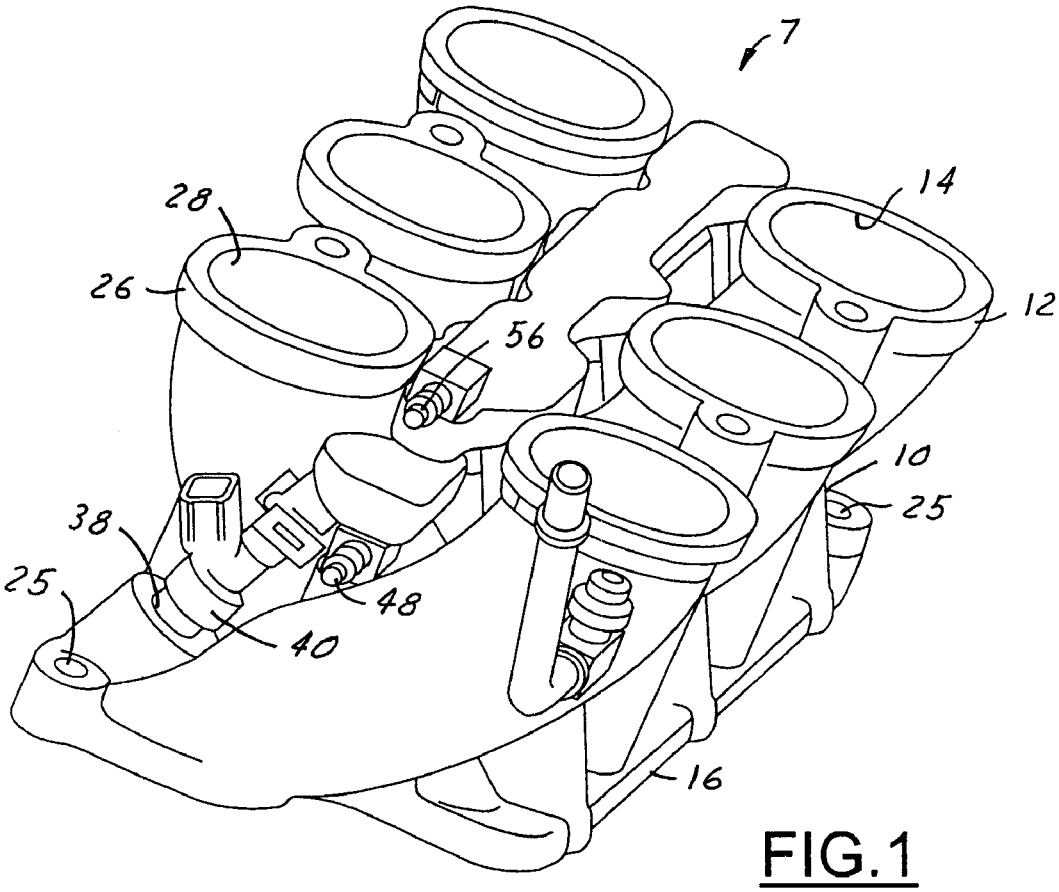
FIG. 1 is a perspective view of an air fuel delivery system arrangement according to the present invention.
Figure 2:
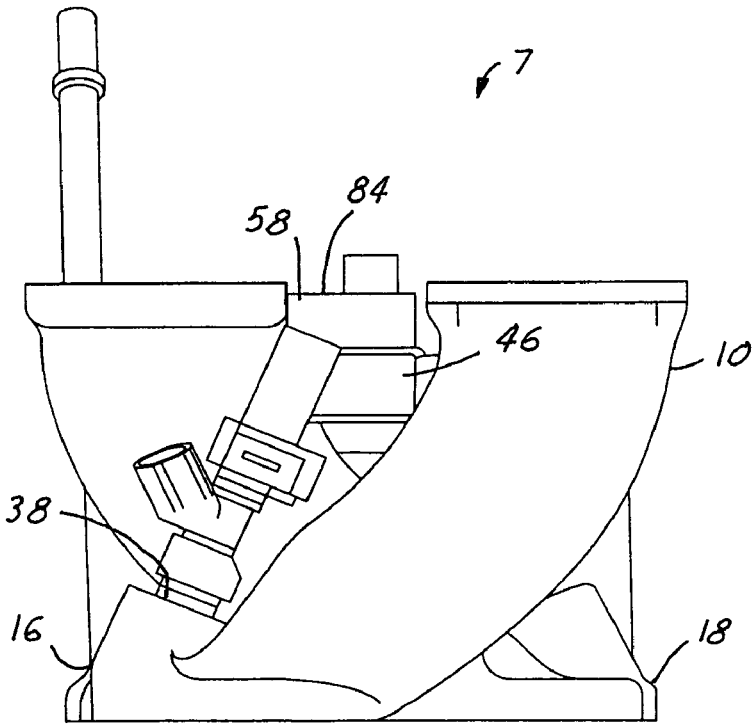
FIG. 2 is a side elevational view of the air fuel delivery system arrangement shown in FIG. 1 slightly tilted and looking generally in an opposite direction from that of FIG. 1.
Figure 3:
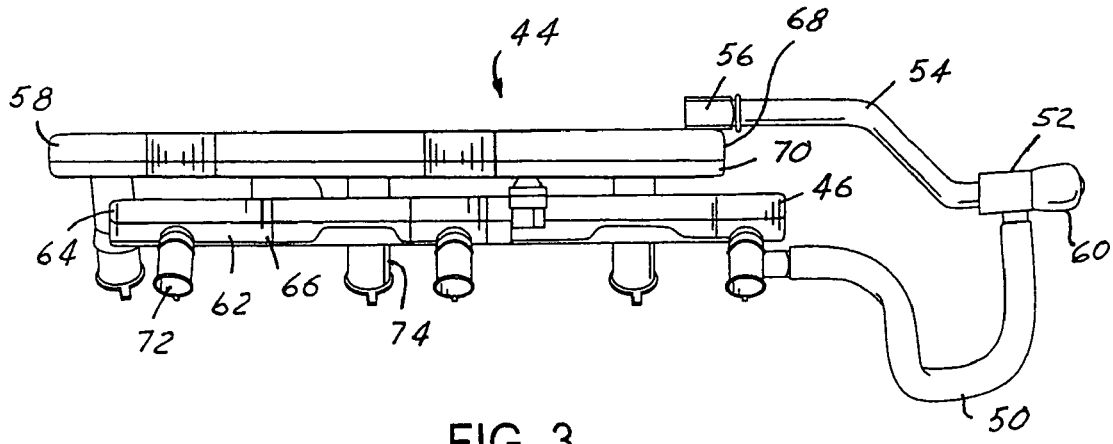
FIG. 3 is a side elevational view a fuel rail combination utilized in the air fuel delivery system arrangement shown in FIGS. 1 and 2.

The air fuel delivery system arrangement 7 of the present invention includes a fuel rail combination 44. The fuel rail combination 44 includes a first generally elongated fuel rail 46. The first fuel rail 46 has a fuel inlet 48. The fuel inlet 48 is connected via a hose 50 (FIG. 3). The hose 50 is connected with a connector 52. The connector 52 is in turn connected with a hose 54, which is connected with a fuel inlet 56 associated with a second fuel rail 58. Fuel is delivered to the connector 52 via a hose 60. The fuel rail combination 44 is of the non-recirculating type. Fuel delivered to the fuel inlets 48, 56 does not recirculate back to a fuel tank or pump reservoir, but instead exits out of the fuel rails as therein delivered through the fuel injectors.

The first fuel rail 46 has an elongated body 62. The fuel rail elongated body 62 has an upper thin stamped female clamshell member 64 which is sealably joined (usually soldered) to a stamped thicker male clamshell member 66. The stampings of the first fuel rail body 62 are essentially identical to the male and female clamshell stampings which make up the second fuel rail 58, with the exception that the second fuel rail 58 has its inlet connected with its top thin female clamshell stamping 68 rather than its lower clamshell stamping 70.

Typically, the female clamshell stamping 64 will be of stainless steel or mild carbon steel having a thickness and range between 0.010 to 0.035 inch. The thick male clamshell stamping 66 will be made of the same material, typically having a thickness in the range of 0.030 to 0.045 inch. The thinness of the female clamshell stamping allows the first fuel rail 46 to be self damping, allowing the upper female clamshell member 64 to absorb pressure pulsations caused by the opening and closing of the fuel injectors connected with the first fuel rail 46.

The thick male stamping 66 has connected thereto three cupped outlets 72. The cupped outlets receive the upper inlet end of the fuel injectors 40. The first fuel rail 46 delivers fuel to the cylinders of the first engine bank 22. The second fuel rail 58 delivers fuel to the second engine bank 32. The main body 62 on the first fuel rail has its male stamping 66 connected with a bracket 73. The bracket 73 is mated with a bracket 76 which is in turn fixably connected with the second fuel rail 58. The brackets 73, 76 have aligned apertures to allow a fastener (not shown) to connect the two brackets to the fuel rail connection tower 36. As shown in FIG. 4, brackets 73, 76 are on the right side. A virtually identical connection arrangement connects the first 46 and second 58 fuel rails on their left side with a similar connection tower 36 (not shown) at a location toward the blind end of the fuel rails.

The brackets 73, 76 by virtue of their connection with their respective male stamped clamshell members do not inhibit the absorption of vibration by the female stamped clamshell members and additionally, are offset so that there is always a clearance between the first and second fuel rails 46, 58.

The cupped outlets 72 of the first fuel rail extend angularly toward the first cylinder bank of the engine for a first given distance, typically 8–15 mm. The cupped outlets 74 of the second fuel rail angularly extend in the opposite direction toward the first cylinder bank 32. The second fuel rail angularly extends outward generally opposite the direction of the cupped outlets 72 toward the second cylinder bank 32.

Since the second fuel rail 58 is aligned generally above the first rail 46, its cupped outlets 74 extend outward typically 25–35 mm, which is a greater distance than the cupped outlets 72. Accordingly, the fuel injectors associated with the second set of runners will have their outlets positioned generally the same as the fuel injectors associated with the first set of runners.

The fuel rail connection brackets 73, 76, in combination with the tower 36 position the fuel rail combination 44 such that the fuel rails are positioned generally between the area next to 14, 28 of the runners. Additionally, the fuel injector combination 44 is typically, but not required to be positioned so that the top surface 84 of the second fuel rail main body is lower than the top surface of the air manifold body 10.

During vehicle assembly, typically the fuel rails 46, 58 will be fluidly connected via the hoses 50, 54. First fuel rail 46 will then be connected with the manifold body 10. Fuel injectors 40 will have their inlet ends sealably connected and inserted within the cupped outlets 72 of the first fuel rail and the outlet end of the fuel injectors 40 will have their outlet ends sealably inserted within the fuel injector inlets 38 of the manifold body.

To prevent damage to the fuel injectors, typically the first fuel rail will be brought in at an angle in order not to damage the fuel injectors. The second fuel rail is then brought in and the aperture on its bracket 76 is aligned with bracket aperture 73. The above angular movement is critical and more acute when using long injector tip type fuel injectors (so-called extended tip injectors), which limit angular movement of the injectors during installation.

Connecting the fasteners with the connection towers 36 will then complete installation of this portion of the fuel rail system 7 to the vehicle.

It is obvious to those skilled in the art that the upper manifold portion will then be connected with the manifold body 10 (not shown). Since the second fuel rail 58 is not fixably connected to the first fuel rail 46 during initial assembly, the second fuel rail 58 can be brought in angularly in such a manner with the proper assembly of its associated fuel injectors and in a manner which minimizes any chance of damage to a fuel injector due to misalignment during assembly.

Figure 6:
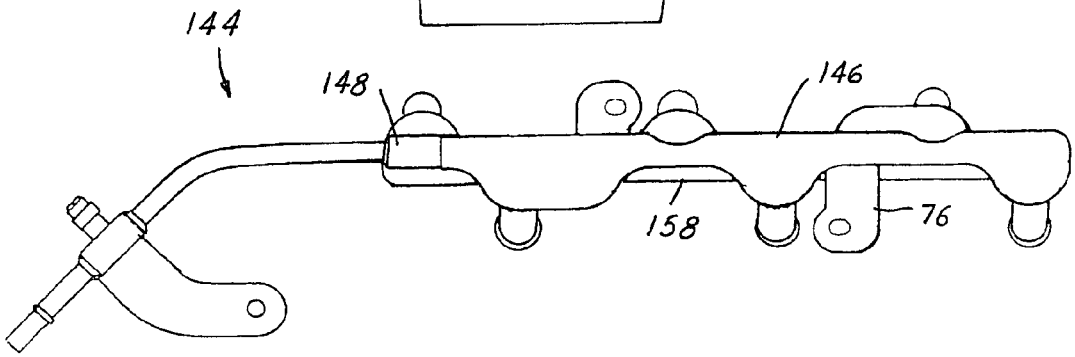
FIG. 6 is a top plan view of an alternate preferred embodiment fuel rail combination to that shown in FIGS. 1–3.
Figure 7:
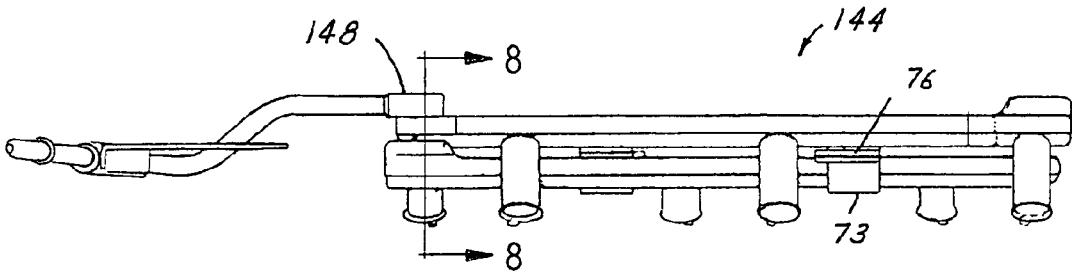
FIG. 7 is a side elevational view of a fuel rail combination to that shown in FIG. 6.
Figure 8:
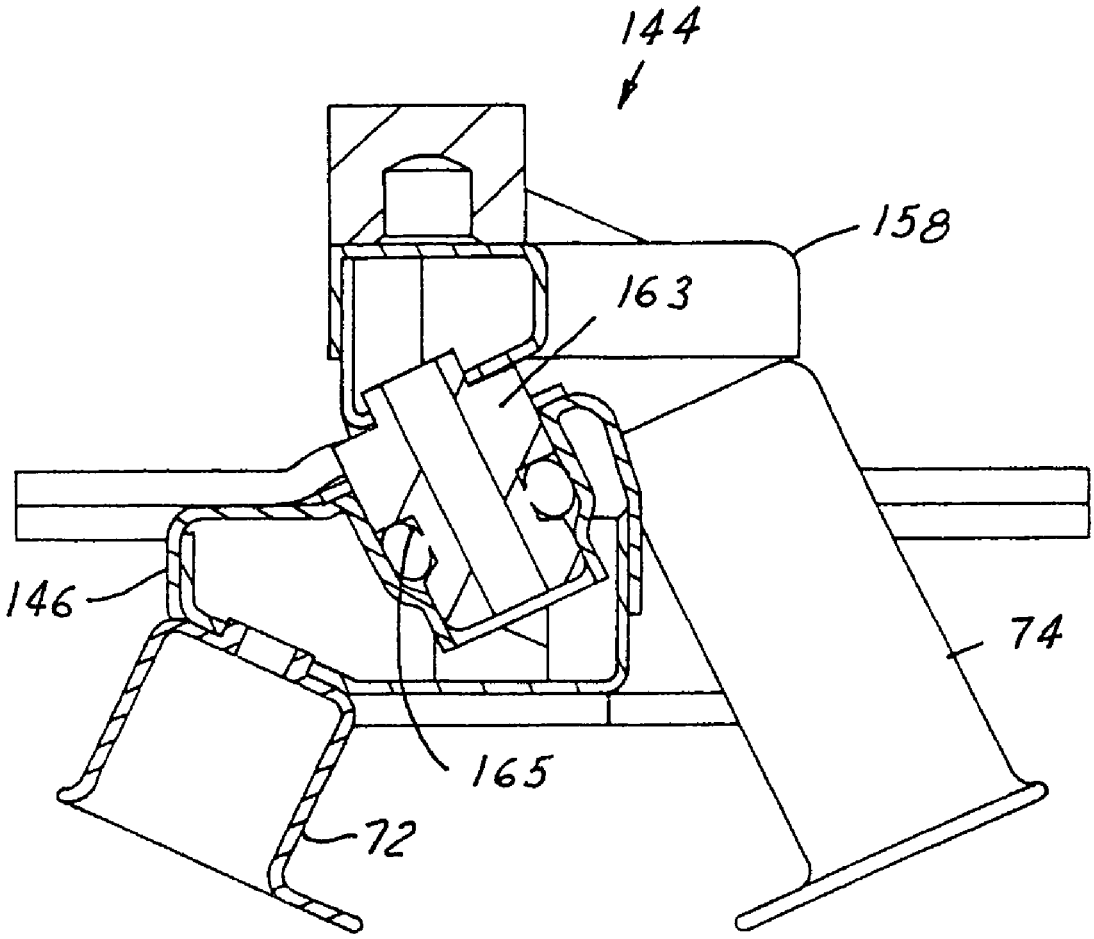
FIG. 8 is a sectional view of the fuel rail combination shown in FIG. 7, taken along line 8—8.

Referring to FIGS. 6–8, an alternative embodiment fuel rail combination 144 is provided. Fuel rail combination 144 has a first fuel rail 146 and a second fuel rail 158. The fuel rails 146, 158 have cupped outlets 72, 74 essentially identical to those described. Additionally, the fuel rails 146, 158 have main bodies generally similar to those aforedescribed. A major difference in the fuel rails 146, 158 is that the second fuel rail 158 has a male fluid connector projection 163 which sealably can be inserted through a female receptacle 165 provided in the lower first fuel rail 146.

Assembly to the manifold body 10 will be essentially identical with the exception that connection of the top fuel rail 158 to the air manifold body 10 will also cause insertion of the male connector 153 within the female receptacle 165. Hence, the fuel rails 146, 158 are directly connected to one another, therefore eliminating any need for a fuel inlet directly to the first fuel rail 146. Accordingly, the fuel inlet 148 of the upper fuel injector serves to provide fuel to both fuel rails 146, 158.

The direction of extension of the male connector 163 will be generally parallel to the direction of extension of the cupped outlets 74 so that the assembly of the top fuel rail to the manifold body and the assembly of the associated fuel injectors between the fuel rail and the manifold body will be along the same path as the insertion of the male connecting member 163.

The present invention has been shown in an embodiment of a self dampening rail. However, the fuel rails of the present invention can have a non-stamped material construction and/or a tubular or polygonal cross sectional construction may be utilized. It will be apparent to those skilled in the art of other changes and modifications which can be made without departing from the spirit or scope of the invention as it is encompassed by the following claims.

The invention claimed is:

1. A fuel rail combination for a V-type spark-ignited liquid fuel internal combustion engine wherein one fuel rail delivers fuel to a first bank of said engine and another fuel rail delivers fuel to another bank of said engine, said combination comprising:

a first elongated fuel rail having a main body with cupped outlets extending angularly therefrom, said first fuel rail cupped outlets extending a first distance, said first fuel rail having a connection bracket connected with said main body with a fastener bracket extending therethrough; and a second elongated fuel rail having a main body for positioning generally adjacent to and above said first fuel rail, said second elongated fuel rail having cupped outlets extending angularly from a main body of said second elongated fuel rail in a generally direction of extension of said first fuel rail cupped outlet, said second fuel outlets extending generally a second distance greater than said first distance, said second fuel rail having a connection bracket with a fastener aperture aligned with said fastener aperture of said connection bracket of said first fuel rail.

2. A fuel rail combination as described in claim 1, wherein said fuel rails main bodies have a thin section for absorption of pressure pulsations and a thick section joined to said thin section, and wherein said connection brackets are connected to said thick section.

3. A fuel rail combination as described in claim 2, wherein said thin section of said first and second fuel rails is on top and wherein said brackets cause said first and second fuel rails to be joined with a clearance therebetween.

4. A fuel rail combination as described in claim 1, wherein said fuel rails are fluidly connected to one another.

5. A fuel rail combination as described in claim 4, wherein said second fuel rail is connected with said first fuel rail via a direct connection via an extension extending between the fuel rails and wherein said manifold extends in a direction generally parallel to the direction of extension of said second cupped outlet.

6. An air fuel delivery system arrangement for a reciprocating piston internal combustion engine comprising:

an air manifold body, said manifold body having a first set of runners for a first engine cylinder bank with inlets on a first side and outlets on a second side of said manifold body, said manifold body having a second set of runners for a second engine cylinder bank with inlets on a second side and outlets on a first side of said manifold body;

a first fuel rail, having outlets for connection with fuel injectors for delivering fuel to said first cylinder bank of said engine, said fuel rail being positioned generally between said inlets of said manifold body; and a second fuel rail, having outlets for connection with fuel injectors for delivering fuel to said second cylinder bank of said engine, said second fuel rail being positioned generally between said inlets of said manifold body being generally vertically aligned with said second fuel rail.

7. An air fuel delivery system arrangement as described in claim 6, wherein said fuel rails are fluidly connected with one another.

8. An air fuel delivery system arrangement as described in claim 7, wherein said fuel rails are of the non-circulating type.

9. An air fuel delivery system arrangement as described in claim 6, wherein said fuel rails have cupped outlets for receipt of said fuel injectors; and wherein a fuel rail which is vertically aligned above said other fuel rail has longer cupped outlets than said other fuel rail.

10. An air fuel delivery system arrangement as described in claim 7, wherein one of said fuel rails has a member insertable in said other fuel rail to allow fluid communication between said fuel rails.

11. An air fuel delivery system arrangement as described in claim 6, wherein said said fuel rails are fluidly connected by a hose.

12. An air fuel delivery system arrangement as described in claim 6, wherein said fuel rails are connected with said manifold body.

13. An air fuel delivery system arrangement as described in claim 6, wherein said first and second fuel rails are substantially identical to one another.

14. An air fuel delivery system arrangement as described in claim 6, wherein said first and second fuel rails are connected to said manifold body by a common fastener.

15. An air fuel delivery system arrangement as described in claim 6, wherein said manifold body has at least one fuel injector inlet.

16. An air fuel delivery system arrangement as described in claim 6, wherein said fuel rails are generally elongated and a major portion of a top of said fuel rail which is located above the other said fuel rail is below a top of said inlet runners of said manifold body.

17. An air fuel delivery system arrangement as described in claim 6, wherein said manifold body is a polymeric molded member.

18. An air fuel delivery system arrangement as described in claim 6, wherein said fuel rails are provided by metallic members.

19. An air fuel delivery system arrangement as described in claim 18, wherein said fuel rails' bodies are formed by two separate members, one member being substantially thinner than said other metallic member to allow for absorption of pressure pulsation by said thinner member.

20. An air fuel delivery system arrangement as described in claim 6, wherein said air manifold body is adapted for a V type engine.

21. An air fuel delivery system arrangement as described in claim 10, wherein said fuel rail having an insert connected thereto, said insert extends in a direction generally parallel with a injector cup connected to said fuel rail which is generally on top.

22. A air fuel delivery system arrangement as described in claim 6, wherein said fuel rails are substantially identical to one another.

23. An air fuel delivery system arrangement for a V-type reciprocating piston internal combustion engine comprising:

a molded air manifold body, said manifold body having a first set of runners for a first engine cylinder bank with air inlets on a first side and air outlets on a second side of said manifold body, said manifold body having a second set of runners for a second cylinder bank with air inlets on a second side of said manifold body and air outlets on a first side of said manifold body and said manifold body having inlets for insertion of fuel injectors to place said fuel injectors in close proximity to said runners;

a first elongated fuel rail having a main body and extending cup outlets for connection with fuel injectors for delivery of fuel to said first cylinder bank of said engine, the first fuel rail being positioned generally between said inlets of said manifold body; and a second elongated fuel rail having a main body and extending cup outlets projecting further from said main body of said fuel rail than said cup outlets of said first fuel rail, said second fuel rail cup outlets providing for connection with fuel injectors for delivering fuel to said second cylinder bank of said engine, said second fuel rail being positioned generally between said air inlets of said manifold body generally above said first fuel rail, and said second fuel rail being fluidly connected with said first fuel rail.

24. A V-type reciprocating piston internal combustion engine comprising:

an engine block having a first bank of cylinders and a second bank of cylinders, said first and second banks of cylinders being angled from one another;

an air manifold body for delivering air to said cylinders, said air manifold body having a first set of runners for said first engine cylinder bank with air inlets on a first side and air outlets on a second side of said manifold body, said manifold body having a second set of runners for said second engine cylinder bank with air inlets on a second side and air outlets on a first side of said manifold body;

a first fuel rail having air outlets for connection with fuel injectors for delivering fuel to said first cylinder bank of said engine, said first fuel rail being positioned generally between said air inlets of said manifold body;

a second fuel rail having air outlets for connection with fuel injectors for delivering fuel to said second cylinder bank of said engine, said second fuel rail being positioned generally between said air inlets of said manifold body and being generally vertically aligned with said first fuel rail; and fuel injectors connected with said outlets of said first and second fuel rails for delivering fuel to said first and second cylinder engine banks.

25. An engine as described in claim 24, wherein said cylinders are inclined from one another by 60 degrees or less.

26. A method of assembling a fuel rail delivery system arrangement to a V-type reciprocating piston internal combustion engine comprising:

providing an air manifold body, said manifold body having a first set of runners for a first engine cylinder bank with air inlets on a first side and air outlets on a second side of said manifold body, said manifold body having a second set of runners for a second engine cylinder bank with air inlets on a second side of said manifold body and air outlets on a first side of said manifold body and providing on said manifold body injector inlets for injecting fuel into said first and second sets of injector runners;

positioning between said inlets of said manifold body a first fuel rail having outlets for connection with fuel injectors for delivering fuel to said first cylinder bank of said engine, and connecting fuel injectors between said fuel rail fuel injector outlets and said manifold body fuel injector inlets; and positioning generally above said first fuel rail a second fuel rail having outlets for fuel injectors for delivering fuel to said second cylinder bank of said engine and connecting fuel injectors between said second fuel rail injector outlet and said injector inlets for said second set of runners.

27. A method as described in claim 26, wherein placement of said second fuel rail with respect to said air manifold body causes an extension of one of said fuel rails to be inserted into said other fuel rail.

* * * * *